US007950914B2

(12) United States Patent
Hooper et al.

(10) Patent No.: US 7,950,914 B2
(45) **Date of Patent: *May 31, 2011**

(54) BRAZE OR SOLDER REINFORCED MOINEAU STATOR

(75) Inventors: Michael E. Hooper, Spring, TX (US); James W. Estep, Spring, TX (US); Wayne Quantz, Kingwood, TX (US); Daniel Symonds, Houston, TX (US); John Clyde Wade, Katy, TX (US); Glennon Allmon Wheeler, Houston, TX (US)

(73) Assignee: Smith International, Inc., Houston, TX (US)

( * ) Notice: Subject to any disclaimer, the term of this patent is extended or adjusted under 35 U.S.C. 154(b) by 818 days.

This patent is subject to a terminal disclaimer.

(21) Appl. No.: 11/810,203

(22) Filed: Jun. 5, 2007

(65) Prior Publication Data

US 2008/0304992 A1 Dec. 11, 2008

(51) Int. Cl.
*F01C 21/00* (2006.01)
*F04C 15/00* (2006.01)
*F04C 29/00* (2006.01)

(52) U.S. Cl. ..... 418/179; 418/48; 418/152; 418/153; 418/178

(58) Field of Classification Search ..... 418/48, 418/152, 153, 178, 179
See application file for complete search history.

(56) References Cited

U.S. PATENT DOCUMENTS 3,268,997 A * 8/1966 Miller ..... 419/27
3,526,953 A * 9/1970 Levinstein ..... 228/178
3,912,426 A 10/1975 Tschirky
3,975,120 A 8/1976 Tschirky
3,975,121 A 8/1976 Tschirky
4,144,001 A 3/1979 Streicher
4,676,725 A 6/1987 Eppink
5,145,342 A 9/1992 Gruber
5,171,138 A 12/1992 Forrest
5,171,139 A 12/1992 Underwood et al.
5,439,359 A 8/1995 Leroy et al.
5,474,432 A 12/1995 Hulley et al.
5,785,913 A * 7/1998 Clark et al. ..... 264/109
5,832,604 A 11/1998 Johnson et al.
6,037,065 A 3/2000 Hajmrle et al.
6,102,681 A 8/2000 Turner (Continued)

FOREIGN PATENT DOCUMENTS

DE 2713468 A 9/1978

OTHER PUBLICATIONS

Office Action dated Mar. 30, 2010 for related U.S. Appl. No. 11/810,202, filed Jun. 5, 2007.

(Continued)

*Primary Examiner* — Thomas E Denion
*Assistant Examiner* — Mary A Davis

(57) ABSTRACT

A Moineau style stator includes a helical reinforcement component that provides an internal helical cavity. A resilient liner is deployed on an inner surface of the helical reinforcement component. The helical reinforcement component includes a solder or braze material and is typically metallurgically bonded to an inner wall of a stator tube. In exemplary embodiments, the helical reinforcement component includes a composite mixture of solder and aggregate. Exemplary embodiments of this invention address the heat build up and subsequent elastomer breakdown in the lobes of prior arts stators by providing a helical reinforcement component. Solder reinforced stators tend to be less expensive to fabricate than reinforced stators of the prior art.

14 Claims, 2 Drawing Sheets

U.S. PATENT DOCUMENTS

| | | | | |
|---|---|---|---|---|
| 6,241,494 | B1 | 6/2001 | Pafitis et al. | |
| 6,293,358 | B1 | 9/2001 | Jager | |
| 6,309,195 | B1 | 10/2001 | Bottos et al. | |
| 6,427,787 | B1 | 8/2002 | Jager | |
| 6,543,132 | B1 | 4/2003 | Krueger et al. | |
| 6,568,076 | B2 | 5/2003 | Bottos et al. | |
| 6,604,921 | B1 | 8/2003 | Plop et al. | |
| 6,604,922 | B1 | 8/2003 | Hache | |
| 6,881,045 | B2 | 4/2005 | Zitka et al. | |
| 6,944,935 | B2 | 9/2005 | Hache | |
| 7,083,401 | B2 | 8/2006 | Hooper | |
| 7,130,108 | B2 | 10/2006 | Yang et al. | |
| 7,396,220 | B2 | 7/2008 | Delpassand et al. | |
| 2005/0079083 | A1 | 4/2005 | Lievestro et al. | |
| 2005/0089429 | A1 | 4/2005 | Delpassand et al. | |
| 2005/0089430 | A1* | 4/2005 | Hooper | 418/48 |
| 2005/0118040 | A1 | 6/2005 | Zitka et al. | |
| 2006/0029507 | A1 | 2/2006 | Kaiser et al. | |
| 2006/0182643 | A1 | 8/2006 | Delpassand et al. | |
| 2008/0023665 | A1* | 1/2008 | Weiser et al. | 252/71 |
| 2008/0304991 | A1* | 12/2008 | Speckert | 418/48 |

OTHER PUBLICATIONS

Response dated Jun. 30, 2010 to Office Action dated Mar. 30, 2010 for related U.S. Appl. No. 11/810,202, filed Jun. 5, 2007.

International Search Report and Written Opinion dated Sep. 25, 2008 for related application No. PCT/US2008/007060 (WO08/153891) filed Jun. 5, 2008.

International Search Report and Written Opinion dated Oct. 7, 2008 for corresponding application No. PCT/US2008/007070 (WO08/153897) filed Jun. 5, 2008.

Republication of WO08/153897 with amended claims filed Dec. 8, 2008.

Informal Comments to the Written Opinion of the ISA dated Dec. 8, 2008 for corresponding application No. PCT/US2008/007070 (WO08/153897) filed Jun. 5, 2008.

Informal Comments to the Written Opinion of the ISA dated Nov. 24, 2008 for related application No. PCT/US2008/007060 (WO08/153891) filed Jun. 5, 2008.

Notice of Allowance mailed Sep. 23, 2010 for related U.S. Appl. No. 11/810,202, filed Jun. 5, 2007.

* cited by examiner

BRAZE OR SOLDER REINFORCED MOINEAU STATOR

RELATED APPLICATIONS

None.

FIELD OF THE INVENTION

The present invention relates generally to positive displacement, Moineau style motors, typically for downhole use. This invention more specifically relates to style stators having helical reinforcement component including a solder material hods for fabricating same.

BACKGROUND OF THE INVENTION

Moineau style hydraulic motors and pumps are conventional in subterranean drilling and artificial lift applications, such as for oil and/or gas exploration. Such motors make use of hydraulic power from drilling fluid to provide torque and rotary power, for example, to a drill bit assembly. The power section of a typical Moineau style motor includes a helical rotor disposed within the helical cavity of a corresponding stator. When viewed in circular cross section, a typical stator shows a plurality of lobes in the helical cavity. In most conventional Moineau style power sections, the rotor lobes and the stator lobes are preferably disposed in an interference fit, with the rotor including one fewer lobe than the stator. Thus, when fluid, such as a conventional drilling fluid, is passed through the helical spaces between rotor and stator, the flow of fluid causes the rotor to rotate relative to the stator (which may be coupled, for example, to a drill string). The rotor may be coupled, for example, through a universal connection and an output shaft to a drill bit assembly.

Conventional stators typically include a helical cavity component bonded to an inner surface of a steel tube. The helical cavity component in such conventional stators typically includes an elastomer (e.g., rubber) and provides a resilient surface with which to facilitate the interference fit with the rotor. Many stators are known in the art in which the helical cavity component is made substantially entirely of a single elastomer layer.

It has been observed that during operations, the elastomer portions of conventional stator lobes are subject to considerable cyclic deflection, due at least in part to the interference fit with the rotor and reactive torque from the rotor. Such cyclic deflection is well known to cause a significant temperature rise in the elastomer. In conventional stators, especially those in which the helical cavity component is made substantially entirely from a single elastomer layer, the greatest temperature rise often occurs at or near the center of the helical lobes. The temperature rise is known to degrade and embrittle the elastomer, eventually causing cracks, cavities, and other types of failure in the lobes. Such elastomer degradation is known to reduce the expected operational life of the stator and necessitate premature replacement thereof. Left unchecked, degradation of the elastomer will eventually undermine the seal between the rotor and stator (essentially destroying the integrity of the interference fit), which results in fluid leakage therebetween. The fluid leakage in turn causes a loss of drive torque and eventually may cause failure of the motor (e.g., stalling of the rotor in the stator) if left unchecked.

Moreover, since such prior art stators include thick elastomer lobes, selection of the elastomer material necessitates a compromise in material properties to minimize lobe deformation under operational stresses and to achieve a suitable seal between rotor and stator. However, it has proved difficult to produce suitable elastomer materials that are both (i) rigid enough to prevent distortion of the stator lobes during operation (which is essential to achieving high drilling or pumping efficiencies) and (ii) resilient enough to perform the sealing function at the rotor stator interface. One solution to this problem has been to increase the length of power sections utilized in subterranean drilling applications. However, increasing stator length tends to increase fabrication cost and complexity and also increases the distance between the drill bit and downhole logging sensors. It is generally desirable to locate logging sensors as close as possible to the drill bit, since they tend to monitor conditions that are remote from the bit when located distant from the bit.

Stators including a reinforced helical cavity component have been developed to address this problem. For example, U.S. Pat. No. 5,171,138 to Forrest and U.S. Pat. No. 6,309,195 to Bottos et al. disclose stators having helical cavity components in which a thin elastomer liner is deployed on the inner surface of a rigid, metallic stator former. The '138 patent discloses a rigid, metallic stator former deployed in a stator tube. The '195 patent discloses a "thick walled" stator having inner and outer helical stator profiles. The use of such rigid stators is disclosed to preserve the shape of the stator lobes during normal operations (i.e., to prevent lobe deformation) and therefore to improve stator efficiency and torque transmission. Moreover, such metallic stators are also disclosed to provide greater heat dissipation than conventional stators including elastomer lobes.

Other reinforcement materials have also been disclosed. For example, U.S. Pat. No. 6,183,226 to Wood et al. and U.S. Patent Publication 20050089429, disclose stators in which the helical cavity component includes an elastomer liner deployed on a fiber reinforced composite reinforcement material. U.S. patent application Ser. No. 11/034,075, which is commonly assigned with the present application, discloses a stator including first and second elastomer layers in which a relatively rigid elastomer layer reinforces a less rigid layer.

While rigid stators have been disclosed to improve the performance of downhole power sections (e.g., to improve torque output), fabrication of such rigid stators is complex and expensive as compared to that of the above described conventional elastomer stators. Most fabrication processes utilized to produce long, internal, multi-lobed helixes in a metal reinforced stator are tooling intensive (such as helical broaching) and/or slow (such as electric discharge machining). As such, rigid stators of the prior art are often only used in demanding applications in which the added expense is acceptable.

The fabrication of composite and rigid elastomer reinforced stators has also proven difficult. For example, removal of the tooling (the stator core) from the injected composite has proven difficult due to the close fitting tolerances and the thermal mismatches between the materials. In order to easily disassemble the tooling, there needs to be a gap between the injected composite matrix and the stator core. This gap may be formed, for example, by radial shrinkage of the composite material; however, axial shrinkage of the composite can cause interference of the stator core and composite helixes. A solution that creates a radial gap without causing axial interference of the helixes is required to disassemble the tooling.

Therefore, there exists a need for yet further improved stators and improved stator manufacturing methods for Moineau style drilling motors. Such stators and stator manufacturing methods would advantageously result in longer service life and improved efficiency in demanding downhole applications.

SUMMARY OF THE INVENTION

The present invention addresses one or more of the above-described drawbacks of conventional Moineau style motors and pumps. Aspects of this invention include a Moineau style stator for use in such motors and/or pumps, such as in a downhole drilling assembly. Stators in accordance with this invention include a helical reinforcement component that provides an internal helical cavity. A resilient liner is deployed on an inner surface of the helical reinforcement component. The helical reinforcement component includes a solder or braze material and is typically metallurgically bonded to an inner wall of a stator tube. In exemplary embodiments, the helical reinforcement component may advantageously include a composite mixture of solder or braze and metal (e.g., steel) aggregate (filler).

Exemplary embodiments of the present invention advantageously provide several technical advantages. Exemplary embodiments of this invention address the heat build up and subsequent elastomer breakdown in the lobes of prior arts stators by providing a helical reinforcement component. As such, various embodiments of the Moineau style stator of this invention may exhibit prolonged service life as compared to conventional Moineau style stators. Further, exemplary stator embodiments of this invention may exhibit improved efficiency (and may thus provide improved torque output when used in power sections) as compared to conventional stators including an all elastomer helical cavity component. Moreover solder and/or braze reinforced stators in accordance with this invention are may be constructed with materials that are less likely to damage the rotor.

Solder and braze reinforced stators of the instant invention are also typically less expensive to fabricate than reinforced stators of the prior art. Methods in accordance with this invention provide for excellent dimensional capability, full thickness of stator walls, and do not reduce the structural integrity of the stator or time-consuming require welding operations.

In one aspect, this invention includes a Moineau style stator. The stator includes an outer stator tube, a helical reinforcement component deployed substantially coaxially in and retained by the stator tube, and a resilient liner deployed on an inner surface of the helical reinforcement component and presented to the internal helical cavity. The helical reinforcement component provides an internal helical cavity and includes a plurality of internal lobes. The helical reinforcement component includes a solder material and is metallurgically bonded to an inner surface of the stator tube.

In another aspect, this invention includes a method for fabricating a Moineau style stator. The method includes casting a plurality of helical reinforcement sections, each of the sections including a solder material and an aggregate. Each of the sections provides an internal helical cavity and including a plurality of internal helical lobes. The cast sections are then concatenated end-to-end on a helical mandrel to form a reinforcement assembly such that each of the internal helical lobes extends in a substantially continuous helix from one longitudinal end of the assembly to an opposing longitudinal end of the assembly. The method further includes inserting the assembly substantially coaxially into a cylindrical stator tube, heating the stator tube to a temperature above the melting temperature of the solder, cooling the stator tube; and removing the mandrel.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiments disclosed may be readily utilized as a basis for modifying or designing other structures for carrying out the same purposes of the present invention. It should also be realize by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 2:
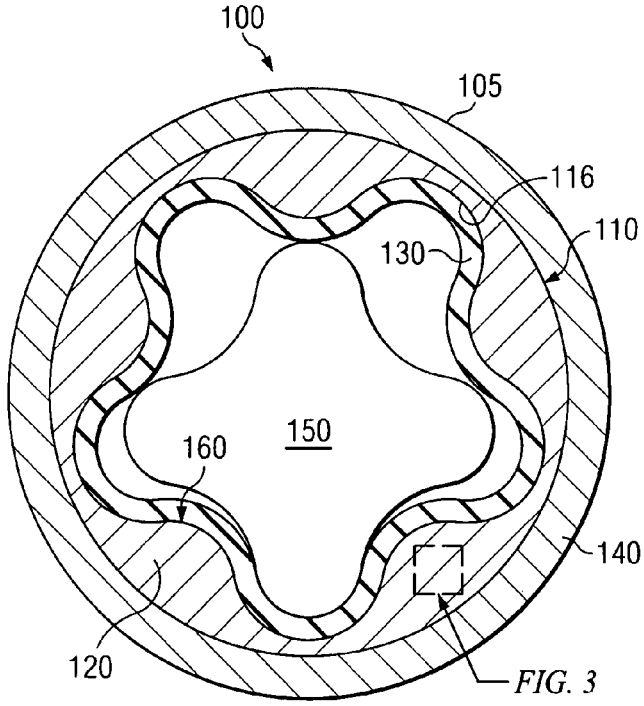
FIG. 2 is a circular cross sectional view of the Moineau style stator as shown on FIG. 1.

FIG. 2 depicts a circular cross-section through a Moineau style power section in an exemplary 4/5 design. In such a design, the differing helical configurations on the rotor and the stator provide, in circular cross section, 4 lobes on the rotor and 5 lobes on the stator. It will be appreciated that this 4/5 design is depicted purely for illustrative purposes only, and that the present invention is in no way limited to any particular choice of helical configurations for the power section design.

Figure 1:
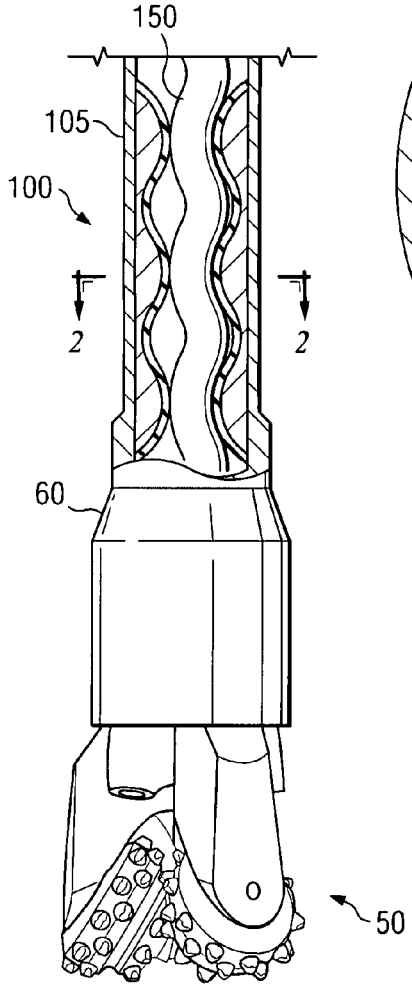
FIG. 1 depicts a conventional drill bit coupled to a Moineau style motor utilizing an exemplary stator embodiment of the present invention.

With reference now to FIG. 1, one exemplary embodiment of a Moineau style power section 100 according to this invention is shown in use in a downhole drilling motor 60. Drilling motor 60 includes a helical rotor 150 deployed in the helical cavity of Moineau style stator 105. In the embodiment shown on FIG. 1, drilling motor 60 is coupled to a drill bit assembly 50 in a configuration suitable, for example, for drilling a subterranean borehole, such as in an oil and/or gas formation. It will be understood that the Moineau style stator 105 of this invention, while shown coupled to a drill bit assembly in FIG. 1, is not limited to downhole applications, but rather may be utilized in substantially any application in which Moineau style motors and/or pumps are used.

Turning now to FIG. 2, which is a cross-section as shown on FIG. 1, power section 100 is shown in circular cross section. Moineau style stator 105 includes an outer stator tube 140 (e.g., a steel tube) retaining a helical cavity portion 110. Helical cavity portion 110 includes a helical reinforcement component 120 having a resilient liner 130 deployed on an inner surface thereof. Helical reinforcement component 120 is shaped to define a plurality of helical lobes 160 (and corresponding grooves) on an inner surface 116 thereof. Helical reinforcement component 120 includes at least one braze and/or solder material. It will be understood to those of ordinary skill in the art that brazes and solders are functionally identical, the only distinction being that brazes have a higher melting temperature than solders (e.g., silver is typically considered a braze, having a melting temperature of about 962 degrees C., while tin is typically considered a solder, having a melting temperature of about 232 degrees C.). For the purposes of this disclosure both brazes and solders will hereafter be referred to as solders. Suitable solders typically include pure metals or alloys of lead, tin, zinc, nickel, copper, bismuth, cadmium, silver, and aluminum.

With continued reference to FIG. 2, the resilient liner 130 may be fabricated from, for example, substantially any suitable elastomer material. In exemplary applications for use downhole in oil and gas exploration, the elastomer material is advantageously selected in view of an expectation of being exposed to various oil based compounds and high service temperatures and pressures.

Figure 3:
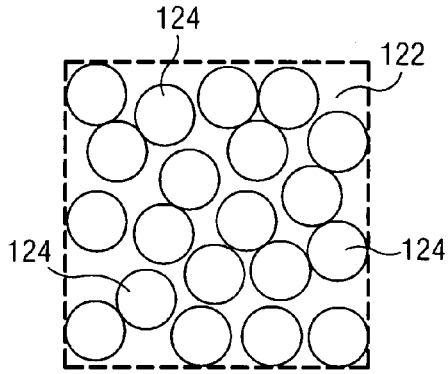
FIG. 3 depicts, in cross-section, a portion of the embodiment shown on FIG. 2.
Figure 4A:
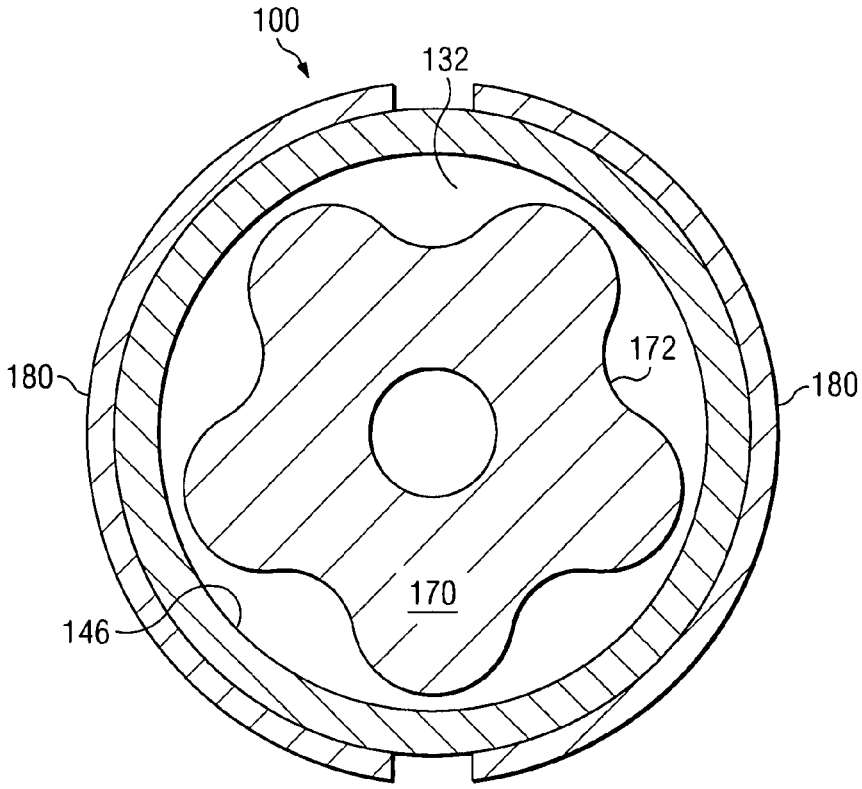
FIGS. 4A and 4B depict, in circular cross section, exemplary arrangements that may be used in the fabrication of the stator shown on FIGS. 2 and 3.

With continued reference to FIG. 2 and further reference to FIG. 3, helical reinforcement component 120 may be advantageously fabricated from a composite mixture of an aggregate 124 deployed in a solder matrix 122. In one advantageous embodiment, the matrix 122 includes a tin solder and the aggregate 124 includes steel particulate and/or steel balls, although the invention is not limited in these regards. Tin is a preferred matrix material due to its melting point of about 232 degrees C., which is typically high enough to withstand stator service temperatures and low enough to preclude the need of any secondary heat treatments of the stator tube. Alternative matrix materials may include pure metals or alloys of lead, zinc, nickel, copper, bismuth, cadmium, silver, and aluminum. Steel aggregate is preferred, in part, because it tends to increase the strength of the helical reinforcement component 120 and because it results in the helical reinforcement component 120 having a thermal expansion coefficient similar to that of the stator tube 140 and stator core 170 (FIG. 4A). While the invention is, of course, not limited in these regards, helical reinforcement component 120 preferably includes from about 10 percent to about 50 volume percent steel aggregate and from about 50 percent to about 90 volume percent tin matrix material.

In FIG. 3, the aggregate 124 is shown to be roughly equant (e.g., spherical). It will be appreciated that the invention is not limited in this regard. Suitable aggregate may be substantially any shape, angularity, and size. Alternative shapes may include tabular (one dimension significantly less than the other two, e.g., a plate), prolate (one dimension significantly greater than the other two, e.g., an elongated cylinder), or bladed (three substantially unequal dimensions, e.g., a knife blade). The angularity may vary from highly angled to well-rounded. Moreover, a mixture of multiple particle shapes may also be advantageously utilized for certain applications.

The aggregate 124 typically varies in size from submicron up to about 0.15 cm. In certain advantageous embodiments, the aggregate 124 may include multiple particle sizes, such as a bimodal distribution having a mixture of relatively small and relatively large particles. The aggregate 124 may also include a broad particle size distribution. It will be appreciated that aggregate having multiple particle sizes (or a broad distribution of particle sizes) tend to pack more efficiently (i.e., with greater density). It will be understood that substantially any filler material (aggregate) may be utilized provided that it bonds with the solder matrix material. Suitable filler materials are typically, although not necessarily, metallic including, for example, steel, iron, copper, zinc, brass, bronze, aluminum, magnesium, nickel, cobalt, tungsten and chrome. Ceramic filler materials may also be suitable for certain embodiments of the invention.

With continued reference to FIG. 2 and further reference to FIGS. 4A and 4B, exemplary methods will now be described for fabricating various embodiments of the progressive cavity stator 105 of this invention. Helical reinforcement component 120 may be deployed on inner surface 146 of stator tube 140 using substantially any known methodology. For example, FIG. 4A shows a first stator core 170, having a plurality of helical grooves formed in an outer surface 172 thereof, deployed substantially coaxially in stator tube 140. Substantially any suitable technique may be utilized to fill the helical cavity 132 with solder and aggregate. For example, the helical cavity may first be filled with aggregate 124 (FIG. 3). The tortuous porous network between the aggregate particles may then be infiltrated with a molten solder. In such an embodiment, the aggregate is typically first coated with a layer of solder (e.g., tinned) prior to deployment in the helical cavity 132 to promote wetting and bonding between the aggregate and solder matrix. Alternatively, the aggregate may be mixed with molten solder to form a slurry, which may then be fed into the helical cavity 132. In another alternative embodiment, solid solder pellets may be mixed with the aggregate and the mixture deployed in the helical cavity 132. Additional liquid solder may be added to the mixture upon heating of the stator (and melting of the solder pellets). It will also be understood that flux may be added to the solder/aggregate mixture at any time during fabrication of the helical reinforcement component 120 to prevent oxidation of the solder and/or aggregate materials. It will further be appreciated that the above described process may be advantageously performed in a vacuum or inert gas atmosphere to prevent oxidation of the aggregate and solder materials.

Prior to insertion of the stator core 170 in stator tube 140, the inner surface 146 of the stator tube 140 may be treated in order to improve the bonding of the solder thereto. Such surface treatment may include, for example, sandblasting, plasma etching, solvent, soap, and/or acid washing, fluxing, etching, caustic dipping, pickling, phosphating, and combinations thereof. Additionally, inner surface 146 may also be plated with the material that readily bonds with the solder, such as zinc, copper, nickel, or tin to promote metallurgical bonding between the helical reinforcement component 120 and the stator tube 140. In exemplary embodiments in which tin solder is used, inner surface 146 may be advantageously "tinned" to promote bonding of the helical reinforcement component 120 with the stator tube 140.

It will be appreciated that molten solder may be fed into the helical cavity 132 using substantially any suitable technique, including for example conventional injection and gravity feeding techniques. Vibration, shock, and/or stator tube rotation may be used to assist in packing and mixing the solder and filler materials. Vacuum casting techniques may also be utilized to assist drawing the liquid solder into the helical cavity 132.

During fabrication, at least a portion of the stator tube 140 and stator core 170 are sometimes heated to either melt the solder or maintain it in a liquid state. Substantially any heating arrangements may be utilized, for example, including induction coils, heating blankets, resistive heating elements deployed inside the core, heat transfer fluid, and ovens. Induction coils, for example, may be deployed at multiple locations along the length of the stator or moved along the length of the stator during fabrication. Of course, the stator tube 140 and stator core 170 may alternatively be moved through one or more induction coils. After the helical cavity 132 has been filled with solder and optional aggregate, the stator tube 140 and stator core 170 may optionally be cooled or quenched to accelerate solidification of the solder. Substantially any suitable techniques may be utilized, for example, including water or oil based quenching, circulating cooled heat transfer fluid through the stator core 170, and/or forced convection of air or mist (e.g., driven by one or more fans).

In such fabrication techniques, it is important to be able to remove the stator core 170 from the helical reinforcement component 120 after solidification of the solder. This may be accomplished by a variety of techniques. For example, stator core 170 may be advantageously fabricated from a material that has approximately the same thermal expansion coefficient as that of the helical reinforcement component 120 to prevent axial locking of the stator core 170 to the helical reinforcement component 120 after cooling. When a steel aggregate 124 is utilized, stator core 170 is typically fabricated from steel, although the invention is not limited in this regard. Alternatively, and/or additionally, outer surface 172 of stator core 170 may be coated or wrapped with a material that prevents the solder from bonding to the stator core 170. Such material may include, for example, salt, cellophane, or dissolvable paper. The salt layer may be dissolved (e.g., with water) after solidification of the solder to create a thin gap between the stator core 170 in the helical reinforcement component 120. Such a gap tends to ease removal of the stator core 170.

Alternatively and/or additionally the stator tube 140 may be radially compressed, for example, with a clamshell die 180 prior to introduction of the solder into the helical cavity 132. After the solder (and optional filler material) has solidified in the helical cavity 132, the clamshell die 180 is removed from the stator tube 140. Expansion of the stator tube 140 (due to removal of the radial compression) creates a gap (e.g., 0.05 mm) between the inner surface 116 of the helical reinforcement component 120 and the outer surface 172 of the stator core 170. As stated above, such a gap is intended to permit easy removal of the stator core from the stator.

In an alternative embodiment, the stator core 170 may be fabricated from a friable material, such as a mixture of foundry sand and resin. In such embodiments, the core 170 may be broken and/or partially dissolved to remove it from the helical reinforcement component 120. For example, in one exemplary embodiment, the stator core 170 is broken into pieces and thereby removed from the helical reinforcement component. A solvent, such as MEK (a methyl ethyl ketone), may then be used to remove any residual core material that remains adhered to the inner surface of the helical reinforcement component 120.

Figure 4B:
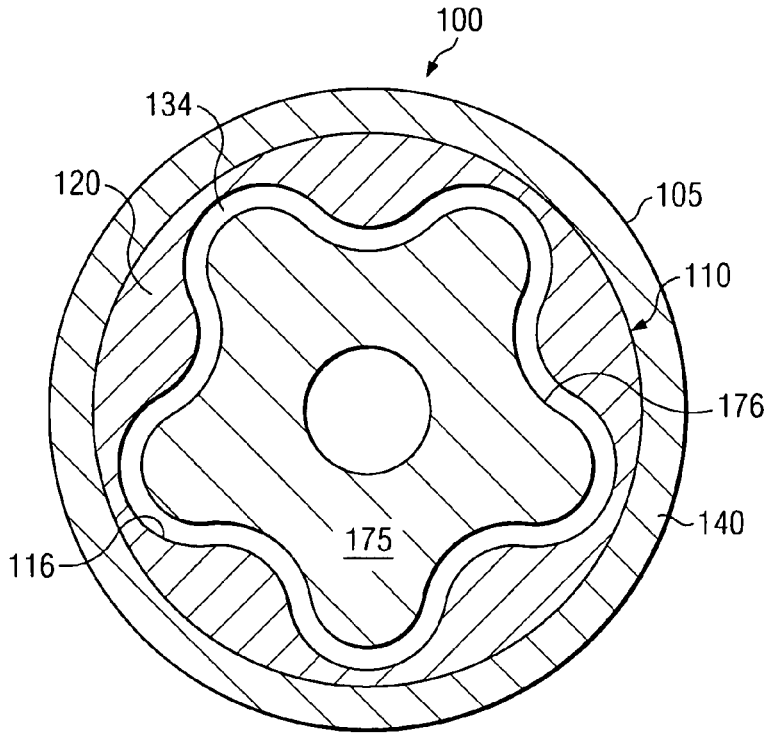

FIG. 4B shows a second stator core 175 (also referred to as a stator former) deployed substantially coaxially in stator tube 140 and helical reinforcement component 120. In the exemplary embodiment shown, stator former 175 has a substantially identical shape in circular cross section to that of stator core 170 (FIG. 4A), although the invention is not limited in this regard. Stator former 175 differs from stator core 170 in that it has smaller major and minor diameters than stator core 170, resulting in a helical space 134 between the outer surface 176 of stator former 175 and inner surface 116 of helical reinforcement component 120. Helical space 134 is substantially filled with a resilient material (such as an elastomer) using conventional elastomer injection techniques. After injection of the elastomer material, the stator may be fully cured in a steam autoclave prior to removing stator core 275.

In an alternative method embodiment in accordance with the present invention, helical reinforcement component 120 may be formed from a plurality of cast stator sections concatenated end to end in a stator tube 140. The stator sections may include substantially any suitable mixture of solder and aggregate (as described above). In one exemplary embodiment, the stator sections are cast from a slurry that includes a mixture of copper coated steel balls immersed in molten tin. Each stator section is shaped to include a plurality of helical lobes (and corresponding grooves) on an inner surface thereof. The stator sections also include a cylindrical outer surface. The cast stator sections are typically (although not necessarily) substantially identical in size and shape and may have substantially any suitable length (along their longitudinal axis). A length in the range from about 3 to about 12 inches tends to advantageously promote quick and inexpensive casting of the stator sections.

The stator sections are typically concatenated end to end on a helical mandrel (such as stator core 170) and inserted into a stator tube 140. To facilitate insertion of the stator sections into the stator core, the outer diameter of the stator sections may be undersized as compared to the inner diameter of the stator tube 140. Likewise the inner diameter may be oversized as compared to the outer surface of the mandrel. After insertion of the multiple stator sections into the stator tube 140, the entire assembly is heated (e.g., as described above) to a temperature greater than the melting temperature of the matrix material (e.g., to about 250 degrees C., which is greater than the melting temperature of tin, but less than the melting temperature of the copper coated steel balls and the stator tube 140). The assembly is advantageously heated for sufficient time to melt substantially all of the matrix material. In this manner, the stator sections are fused (melted) together to form a unitary helical reinforcement component 120 (e.g., including copper coated steel balls deployed in a tin matrix). Melting the matrix material also advantageously promotes bonding of the reinforcement component 120 with the stator tube 140.

After cooling the assembly, the mandrel may be removed using substantially any suitable procedure (e.g., as described above). An elastomer liner may then be formed on the inner surface of the helical reinforcement component 120, for example, as described above with respect to FIG. 4B.

Although the present invention and its advantages have been described in detail, it should be understood that various changes, substitutions and alternations can be made herein without departing from the spirit and scope of the invention as defined by the appended claims.

We claim:

1. A stator for use in a Moineau style power section, the stator comprising:

an outer stator tube;

a helical reinforcement component deployed substantially coaxially in and retained by the stator tube, the helical reinforcement component being metallurgically bonded to an inner surface of the stator tube, the helical reinforcement component comprises a composite mixture of a metallic or ceramic filler material deployed in a solder matrix, the helical reinforcement component providing an internal helical cavity and including a plurality of internal lobes, wherein the melting temperature of the solder matrix is less than the melting temperature of the filler material;

a resilient liner deployed on an inner surface of the helical reinforcement component and presented to the internal helical cavity.

2. The stator of claim 1, wherein the solder material is selected from the group consisting of nickel, copper, zinc, tin, lead, bismuth, cadmium, silver, aluminum, and mixtures thereof.

3. The stator of claim 1, wherein the filler material is a metallic filler material selected from the group consisting of steel, iron, copper, zinc, and mixtures thereof.

4. The stator of claim 1, wherein the filler material includes a particle size in the range from submicron to about 0.15 cm.

5. The stator of claim 1, wherein the filler material includes particulate having at least two particle sizes and at least two particle shapes.

6. The stator of claim 1, wherein the filler material is coated with a material that is metallurgically receptive to the solder.

7. The stator of claim 1, wherein the resilient liner is fabricated from an elastomer material.

8. The stator of claim 1, wherein the composite mixture comprises from about 10 percent to about 50 volume percent steel aggregate filler material and from about 50 percent to about 90 volume percent tin solder matrix material.

9. A subterranean drilling motor comprising:

a rotor having a plurality of rotor lobes on a helical outer surface of the rotor;

a stator including a helical reinforcement component deployed substantially coaxially in and retained by a stator tube, the helical reinforcement component being metallurgically bonded to an inner surface of the stator tube, the helical reinforcement component further comprises a composite mixture of a metallic or ceramic filler material deployed in a solder matrix, wherein the melting temperature of the solder matrix is less than the melting temperature of the filler material, the helical reinforcement component providing an internal helical cavity and including a plurality of internal lobes, the stator further including a resilient liner deployed on an inner surface of the helical reinforcement component and presented to the internal helical cavity, the rotor deployable in the helical cavity of the stator such that an outer surface of the rotor is in a rotational interference fit with the resilient liner.

10. The stator of claim 9, wherein the solder material is selected from the group consisting of nickel, copper, zinc, tin, lead, bismuth, cadmium, silver, aluminum, and mixtures thereof.

11. The stator of claim 9, wherein the filler material is a metallic filler material selected from the group consisting of steel, iron, copper, zinc, and mixtures thereof.

12. The stator of claim 9, wherein the resilient liner is fabricated from an elastomer material.

13. The stator of claim 9, wherein the composite mixture comprises from about 10 percent to about 50 volume percent steel aggregate filler material and from about 50 percent to about 90 volume percent tin solder matrix material.

14. A stator for use in a Moineau style power section, the stator comprising:

an outer stator tube;

a helical reinforcement component deployed substantially coaxially in and retained by the stator tube, the helical reinforcement component being metallurgically bonded to an inner surface of the stator tube, the helical reinforcement component comprises a composite mixture of a metallic or ceramic filler material deployed in a solder matrix, the helical reinforcement component providing an internal helical cavity and including a plurality of internal lobes, wherein the composite mixture comprises from about 10 percent to about 50 volume percent of the filler material and from about 50 percent to about 90 volume percent of the solder matrix, and wherein the melting temperature of the solder matrix is less than the melting temperature of the filler material; and a resilient liner deployed on an inner surface of the helical reinforcement component and presented to the internal helical cavity.

* * * * *